US005911610A

United States Patent [19]

Fujimoto

[11] Patent Number: 5,911,610

[45] Date of Patent: Jun. 15, 1999

[54] OUTBOARD MOTOR EXHAUST SYSTEM

[75] Inventor: Hiroaki Fujimoto, Hamamatsu, Japan

[73] Assignee: Sanshin Kogyo Kabushiki Kaisha, Hamamatsu, Japan

[21] Appl. No.: 08/909,858

[22] Filed: Aug. 12, 1997

[51] Int. Cl.[6] ..... B63H 21/32

[52] U.S. Cl. ..... 440/89

[58] Field of Search ..... 440/1, 2, 88, 89; 60/277, 299, 302

[56] References Cited

U.S. PATENT DOCUMENTS

| | | | |
|---|---|---|---|
| 5,037,338 | 8/1991 | Anderson et al. | 440/1 |
| 5,261,376 | 11/1993 | Kato et al. . | |
| 5,433,634 | 7/1995 | Nakayama et al. | 440/1 |
| 5,575,699 | 11/1996 | Isogawa et al. | 440/89 |
| 5,615,661 | 4/1997 | Suzuki . | |
| 5,637,792 | 6/1997 | Kimura et al. . | |
| 5,797,775 | 8/1998 | Ozawa et al. | 440/1 |

*Primary Examiner*—Stephen Avila

*Attorney, Agent, or Firm*—Knobbe, Martens, Olson & Bear LLP

[57] ABSTRACT

A catalytic exhaust system for an outboard motor having an engine positioned in a cowling thereof is disclosed. The exhaust system leads from an exhaust port of the engine to a discharge from the motor. A catalyst is positioned in the exhaust system for catalyzing exhaust gases. A first port is positioned in the exhaust system downstream of the catalyst through which an exhaust gas probe may be selectively extended for obtaining an exhaust gas sample. Additionally, a second port is preferably provided between the catalyst and the first port and through which an exhaust gas temperature sensor extends.

14 Claims, 5 Drawing Sheets

OUTBOARD MOTOR EXHAUST SYSTEM

FIELD OF THE INVENTION

This invention relates to an outboard motor exhaust system and more particularly to an improved catalytic exhaust system for an outboard motor.

BACKGROUND OF THE INVENTION

Because of the compact nature of outboard motors, the design of many of the components of the outboard motor is made quite difficult. A specific area where the size constraints present problems is in the design of the exhaust system for the outboard motor. In many vehicle applications, the exhaust system which transfers the exhaust gases from the engine to the atmosphere can have its length and shape varied within large parameters due to the nature of the vehicle that is powered. However, with outboard motors the exhaust system must be very compact and hence the silencing efficiency and tuning becomes quite a problem. For this reason, it is the normal practice to discharge the exhaust gases to the atmosphere, through an underwater exhaust gas discharge, under most running conditions. In this way, the exhaust gases are cooled and silenced by the body of water in which the watercraft is operating.

Also, it has been proposed to introduce the cooling water from the engine cooling jacket into the exhaust system so as to assist in the silencing and cooling of the exhaust gases. Cooling of the exhaust gases is important because this not only aids in the silencing, but it protects surrounding components from the heat of the exhaust. This heat transfer is a particular problem because of the compact nature of the outboard motor.

However, with increasing emphasis on protection of the environment, it is necessary or desirable to employ catalytic treatment systems for the exhaust gases. The catalyst can be utilized to remove harmful constituents from the exhaust gases or to transform them into less harmful products before they are discharged. Since the exhaust gases are also delivered to the atmosphere through the body of water in which the watercraft is operating, the control of water pollution also may dictate the desirability of employing catalysts.

However and is well known, the catalyst normally operates at a relatively high temperature to be effective. Also, the material of the catalyst is such that if it is cooled suddenly, the catalyst bed may fracture. Also, any water which may come in contact with the catalyst can pollute the catalyst by leaving deposits when the water evaporates. These problems are particularly acute in conjunction with operation in marine environments. The salt water can leave salt deposits on the catalyst that can foul it and reduce its capability of performing its intended functions.

In order to protect the catalyst from water damage, particularly when considering the fact that the exhaust gases have a discharge outlet that is below the water level, it is desirable to position the catalyst relatively high in the outboard motor. Such high locations will assist in protecting the catalyst. However, if the catalyst is positioned in close proximity to the power head, then the heat transfer problems become particularly acute. This is particularly true since a portion of the protective cowling of the power head is formed from a nonmetallic material, such as a molded fiberglass reinforced resin or the like. These materials are quite susceptible to damage under high temperatures.

It is also desirable to mount the catalyst in close proximity to the exhaust ports of the engine. This is because the catalyst should be at a high temperature in order to perform its operation. Thus, with the foregoing problems in mind, it has been proposed to mount a catalyst on the underside of an exhaust guide plate that receives the exhaust gases directly from the exhaust manifold of the engine. However, this positioning of the catalyst within the drive shaft housing raises a possibility of its being contacted by water with the aforenoted deleterious affects. Therefore, it has been proposed to employ certain protective devices, including the enclosing of the catalyst within a closed chamber in the drive shaft housing.

With all of these protection methods, there still is a possibility that the catalyst may become contaminated in use. This is particularly true when operating in marine environments because it is difficult, if not impossible, to totally isolate the catalyst from water vapor in the atmosphere.

If the catalyst becomes fowled with deposits, such as salt, it is rendered less effective, as aforenoted. A primary method of determining if the catalyst is operating effectively is to analyze the exhaust gases.

It is, therefore, an object of the present invention to provide an improved catalytic exhaust system for an outboard motor which conveniently permits the testing of the exhaust gases to determine if they are being properly catalyzed. In addition, it is an object of the invention to provide such a system which further including a means for sensing the exhaust gas temperature.

SUMMARY OF THE INVENTION

This invention is adapted to be embodied in an outboard motor that is comprised of a power head containing an internal combustion engine positioned within a protective cowling. A drive shaft housing and lower unit depends from the power head and contains a propulsion device for the associated watercraft. Transmission means drive the propulsion device from the engine. The engine has at least one exhaust port for the discharge of combustion products. An exhaust system delivers the exhaust gases from the exhaust port to the atmosphere through an underwater exhaust gas discharge under at least some running conditions. A catalyst is disposed in the exhaust system for treating the exhaust gases passing therethrough.

In accordance with the present invention, a first port is provided in the exhaust system downstream of the catalyst. This port is adapted to selectively receive an exhaust gas probe for obtaining an exhaust gas sample for analyzing. When not in use, the port may be closed with a plug. Additionally, a second port is preferably provided in the exhaust system near said catalyst but downstream thereof. An exhaust gas temperature sensor extends through the second port for obtaining exhaust gas temperature data.

Preferably, the portion of the exhaust system in which each port is positioned is a trap having a first vertically upwardly extending portion, a generally horizontally extending portion and then a generally vertically downwardly extending portion. The ports are provided in the vertically extending portions of the trap so that the probes are positioned generally perpendicular to the flow of exhaust gas through that portion of the exhaust system.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
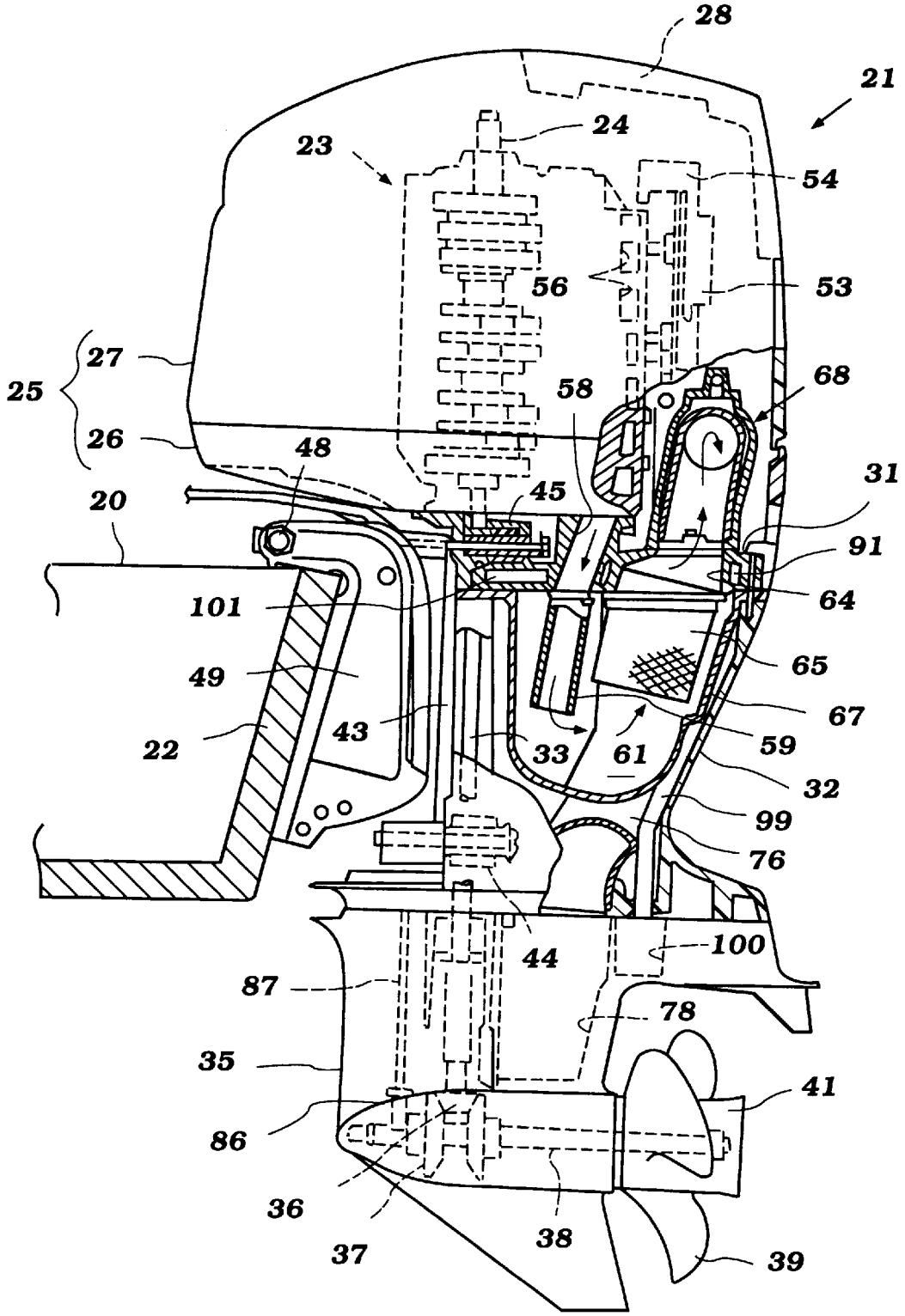
FIG. 1 is a side elevational view of an outboard motor constructed in accordance with an embodiment of the invention, shown attached to the transom of an associated watercraft, which is shown partially and in cross-section, and with a portion of the outboard motor broken away to more clearly show the exhaust system.

Referring now in detail to the drawings, an outboard motor constructed in accordance with an embodiment of the invention is identified generally by the reference numeral 21 and is shown as being attached to a transom 22 of an associated watercraft 20 which is shown partially and in cross-section in FIG. 1. Since the invention deals primarily with the exhaust system for the outboard motor 21, many components of the outboard motor are shown only schematically and may not be described in full detail. Where that is the case, reference may be had to any conventional structure which can be utilized with the invention.

The outboard motor 21 is comprised of a power head that includes an internal combustion engine, indicated generally by the reference numeral 23 and shown, for the most part, either in phantom or in broken lines. It will be readily apparent to those skilled in the art how the invention may be utilized in conjunction with any of a wide variety of internal combustion engines. In the illustrated embodiment, the engine 23 is depicted as being of the V-6 crankcase compression, 2-cycle type. It will be readily apparent, however, to those skilled in the art, how the invention may be employed in conjunction with engines having other cylinder numbers and other configurations. Also the invention may be practiced with four cycle or rotary engines.

The engine 23 is mounted in the power head so that a crankshaft 24 thereof rotates about a vertically disposed axis. This is to facilitate connection to a drive shaft, to be described later. The power head is completed by a protective cowling, indicated generally by the reference numeral 25, and which is comprised of a lower tray portion 26 and an upper main cowling portion 27. As is typical in this art, the tray portion 26 may be formed from a material such as an aluminum or aluminum alloy. The main cowling portion 27, on the other hand, is formed from a lighter weight, less rigid material such as a molded fiberglass reinforced resin or the like. The main cowling portion 27 is also provided with an insert piece that defines a protected atmospheric air inlet 28 through which air is drawn from the atmosphere for combustion in the engine 23 in a known manner.

Figure 2:
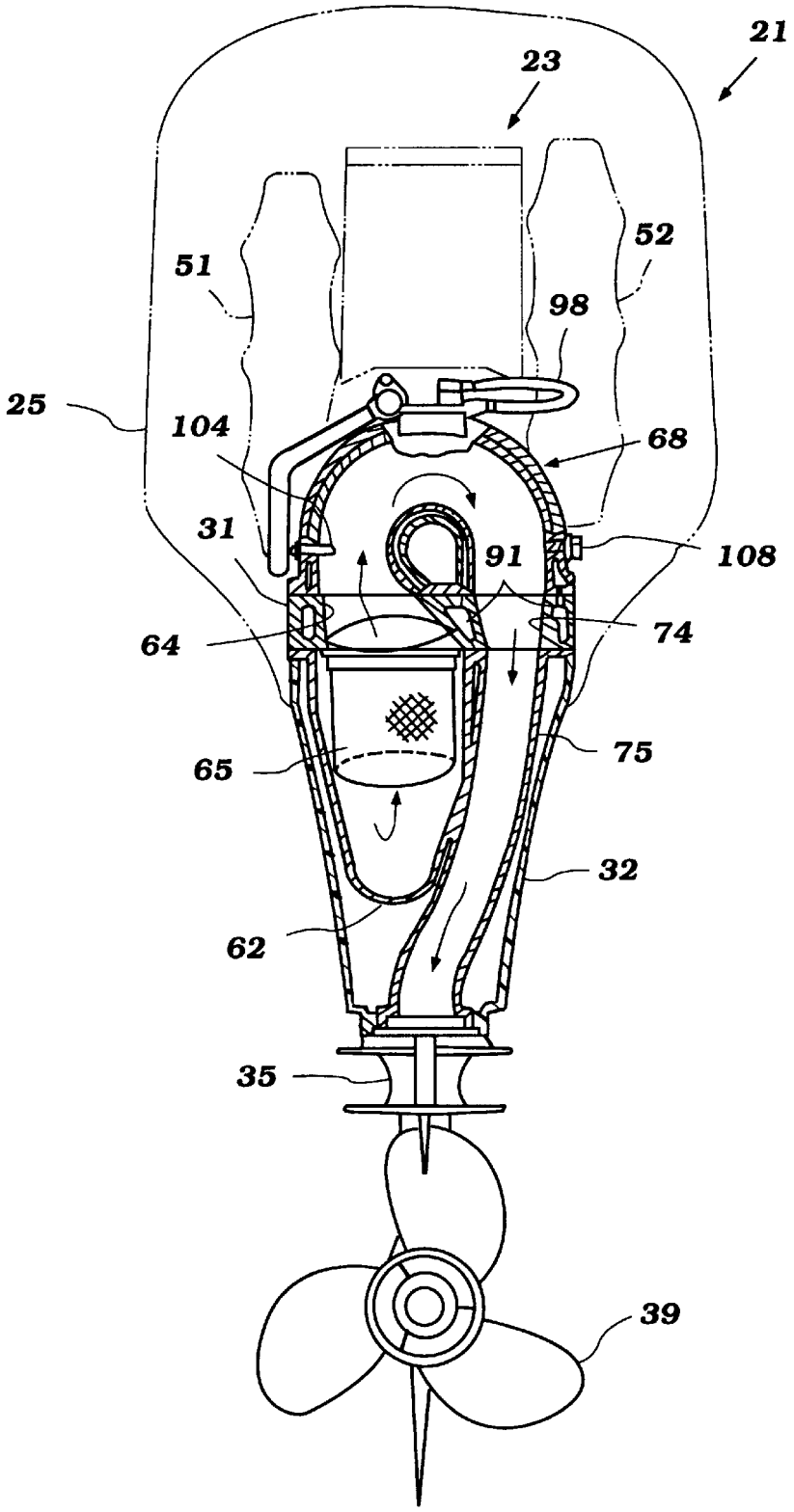
FIG. 2 is a rear elevational view of the outboard motor, again showing portions in phantom, portions of the exhaust system broken away and in cross-section, and other portions in solid lines.

The induction system for the engine 23 is shown partially in broken lines in FIG. 2. This induction system is indicated generally by the reference numeral 29 and is disposed, in the illustrated embodiment, so that it extends forwardly toward the transom 22 and may, in fact, extend partially over it. This induction system 29 delivers at least an air charge to the crankcase chambers of the engine in which the crankshaft 24 rotates. Again, since this construction may be of any known type, a further description of it is not believed to be necessary.

The engine 23 is mounted on the upper side of a exhaust guide plate, indicated generally by the reference numeral 31, which exhaust guide plate extends into the upper end of a drive shaft housing, indicated generally by the reference numeral 32. A drive shaft 33 is rotatably journaled within the drive shaft housing 32 in a known manner and is coupled by means of a coupling to the lower end of the crankshaft 24 so as to create a driving relationship therebetween.

From the drive shaft housing 32, the drive shaft 33 depends into a lower unit 35. Within the lower unit 35, a bevel gear 36 is affixed to the drive shaft 33. This bevel gear 36 is enmeshed with the counter-rotating bevel gears of a forward-neutral-reverse transmission 37 of a known type. This transmission 37 is adapted to drive a propeller shaft 38 in selected forward or reverse directions, so driving a propeller 39 which forms the propulsion device for the watercraft having the transom 22. The propeller 39 is provided with an enlarged hub 41 having a through-the-hub exhaust gas discharge opening formed therein which cooperates with an exhaust system to be described.

A steering shaft, not shown, is rotatably journaled within a swivel bracket 43 formed at the front of the drive shaft housing 32. This steering shaft is connected to the drive shaft housing 32 by means of a pair of lower elastic support bracket assemblies 44. An upper pair of elastic support bracket assemblies 45 connects the upper end of the steering shaft to a portion 46 of the guide plate 31. Hence, the power head 25, drive shaft housing 32 and lower unit 25 are pivotal relative to the swivel bracket 43 about the axis defined by this steering shaft. This affects steering of the outboard motor 21 in a well known manner.

A pivot pin 48 connects the swivel bracket 43 to a clamping bracket 49. This pivotal connection affords tilt and trim movement of the outboard motor 21 as is also well known in this art. The clamping bracket 49 carries a suitable mechanism by which it may be attached to the watercraft transom 22.

Figure 3:
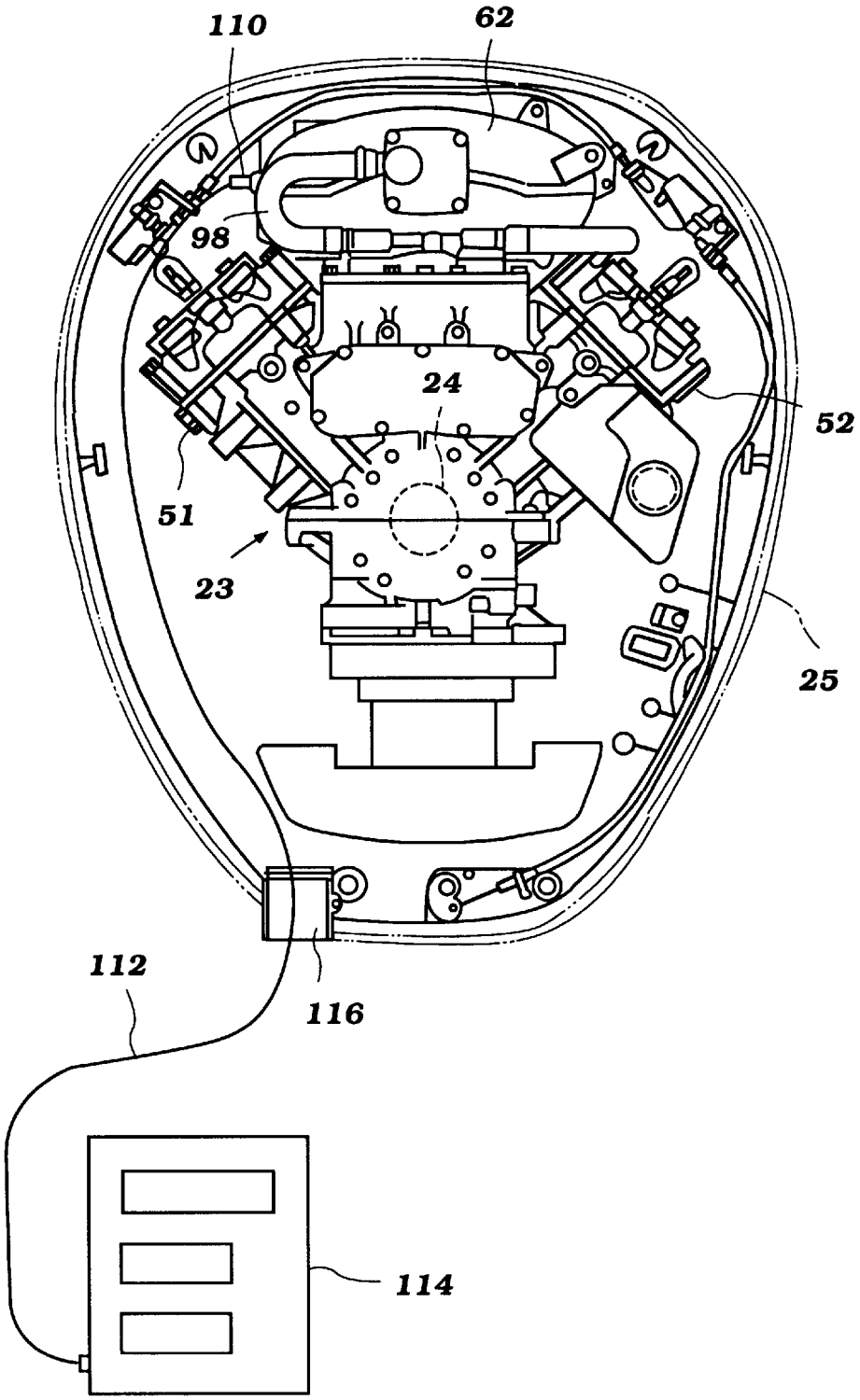
FIG. 3 is a top plan view of the power head with at least a portion of the protective cowling removed and other portions shown in phantom.

As best illustrated in FIG. 3, the engine 23 is comprised of a pair of angularly disposed cylinder banks 51 and 52, each of which forms three cylinder bores since, as has been noted, the engine 23 is of the V-6 type. These cylinder banks 51 and 52 diverge rearwardly and define a valley between them. Positioned within this valley are certain electrical components such as a capacitor discharge ignition circuit 53 and a voltage regulator rectifier circuit 54. In addition, an electronic engine control unit (ECU) (not shown) may be used to control a number of engine functions, including the ignition circuit 53. These electrical components are disposed beneath the air inlet 28 so that they will be cooled. These cooperate with a magneto generator (not shown) that is formed in part by a flywheel assembly affixed to the upper end of the crankshaft 24. This ignition system fires the spark plugs for the engine 23 in a known manner.

Exhaust from the cylinders of the engine 23 is discharged through respective exhaust ports 56 formed in the cylinder banks 51 and 52 on the valley side of the engine. These exhaust ports 56 cooperate with respective exhaust manifolds formed internally within the cylinder block banks 51 and 52 and which terminate in downwardly facing exhaust discharge openings. These openings lead into an exhaust system for discharging the exhaust gases to the atmosphere through, at times, the aforenoted underwater through-the-propeller-hub exhaust gas discharge opening. This exhaust system includes a pair of exhaust passages 58 formed in side-by-side relationship in the exhaust guide 31 and which are aligned with the exhaust manifold outlet openings 57.

A pair of upper exhaust pipes 59 are affixed to the underside of the exhaust guide plate 31 and receive the exhaust gases transmitted through the exhaust guide plate openings 58. These exhaust pipes 59 terminate in an expansion chamber, indicated generally by the reference numeral 61 and which is formed by means of a generally bag-shaped enclosure member 62 having a flange 63 that is affixed to the underside of the guide plate 31 by means of a plurality of fasteners.

The exhaust gases entering the expansion chamber 61 from the exhaust pipes 59 will expand and this expansion causes some silencing of the exhaust gases and also some cooling of them. The exhaust gases then flow upwardly to reenter the power head within the protective cowling 25 through a further exhaust passage or opening 64 formed in the guide plate 31.

However, before passing through the opening 64, the exhaust gases pass through a catalyst bed 65 which is mounted by means of a flange assembly 66 on the underside of the guide plate 31. The catalyst bed 65 may be of an appropriate material to treat the exhaust gases. Preferably, the bed 65 is of the open type so that the exhaust gases can flow through it but will contact the surface of the catalyst material for its treatment.

Because of the fact that the catalyst bed 65 is mounted by the flange assembly 66, it may be easily removed for servicing and replacement by removing the exhaust guide plate 31 from the assembly and then replacing the catalyst bed.

It should also be seen that the catalyst bed 65 has a portion that extends upwardly beyond the flange 66 and into the guide opening 64. This permits a compact assembly. In addition, the member 62 that forms the expansion chamber 61 is provided with an offset shoulder 67 (see FIG. 1) so as to provide clearance for the bed 66 but still maintaining an air gap between the outer periphery of the member 62 and the inner periphery of the drive shaft housing 32.

Figure 4:
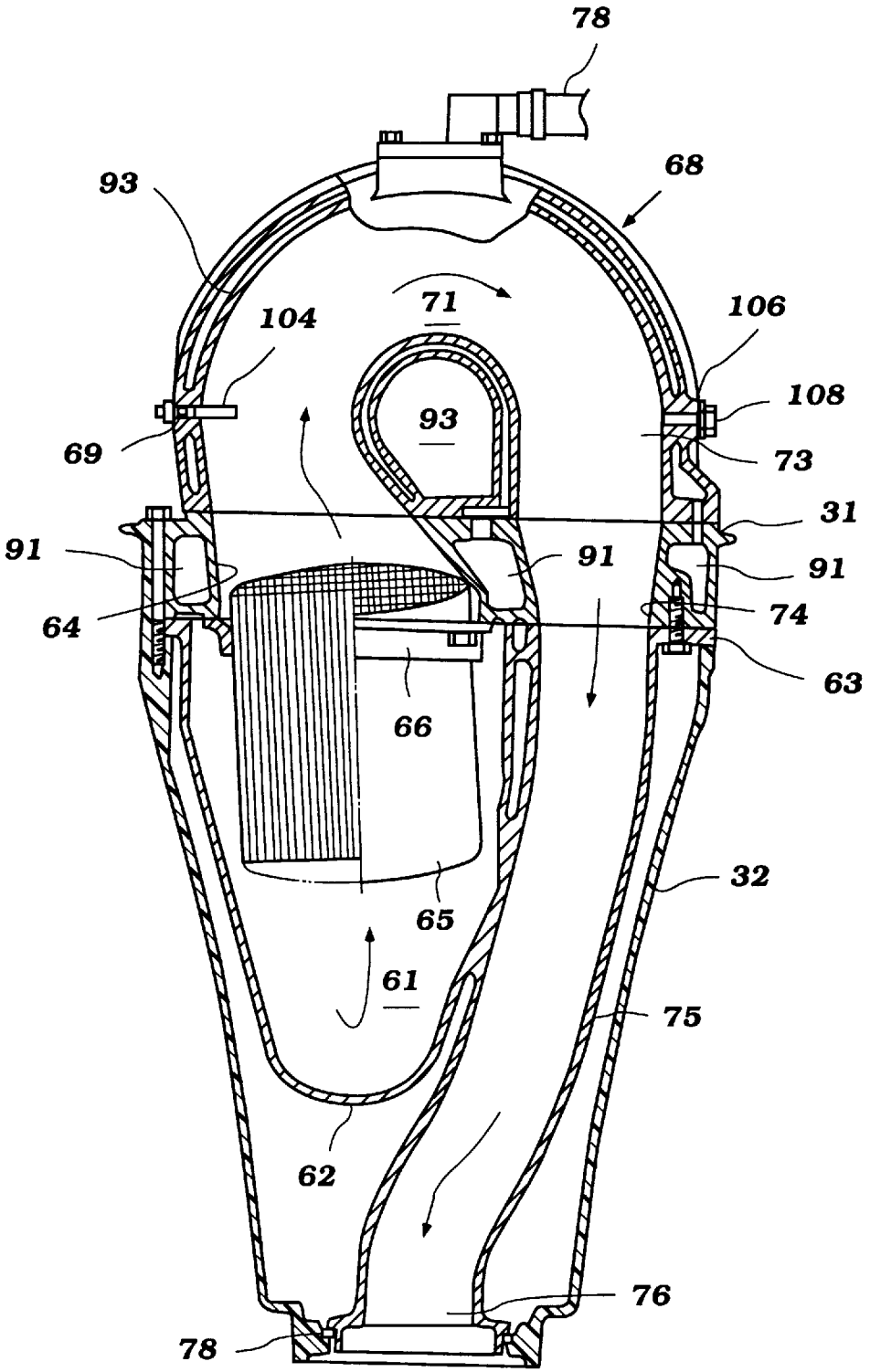
FIG. 4 is an enlarged cross-sectional view showing the portions of the exhaust components shown in cross-section in FIG. 2.

A trap or lower exhaust pipe section, indicated generally by the reference numeral 68 and having a construction as best seen FIGS. 1, 2 and 4 is affixed to the upper side of the exhaust guide plate 31 and within the protective cowling 25. This trap section 68 is disposed at the rear of the power head and includes a first vertically extending inlet section 69. The inlet section 69 extends generally upwardly from the opening 64 in the exhaust guide plate to receive the exhaust gases that have passed through the catalyst bed 65. At the upper end, the section 69 merges into a generally horizontally extending section 71 which is positioned, as shown in FIGS. 1 an 2 at a vertical distance above the lower most exhaust port 56 of the engine. As will become apparent, this configuration provides a trap inasmuch as a lower surface of the portion 71 is disposed at a relatively high height. Thus, water which may tend to try to enter the engine through the exhaust system must flow higher than this distance before it can reach the catalyst bed 65 and/or the lower ends of the exhaust pipes 59.

A further downwardly extending section 73 extends from the termination of the horizontal portion 71 and is aligned with a further exhaust opening 74 formed in the exhaust guide plate 31. It should be noted that the trap section 68 extends generally in a direction transversely of the longitudinal axis of the outboard motor 21. This is generally parallel to the trim axis 48 and, thus, provides further assurances that water may not be driven upwardly through the exhaust system during sudden slowdowns in watercraft movement.

Formed integrally with the member 61 is an exhaust outlet pipe section 75 which extends downwardly on one side of the expansion chamber 61 and which terminates in an outlet opening 76. The outlet opening 76 is surrounded by an elastic seal 78 to provide a seal around the lower end of the drive shaft housing 32. This outlet end communicates with an exhaust cavity 78 (see FIG. 1) formed in the lower unit 35 and which communicates with the through the hub exhaust discharge assembly in a known movement.

From the foregoing description, it should be apparent that, although the exhaust gases are discharged through a below the water exhaust gas discharge specifically the discharge in the hub 41 of the propeller 39, before any water can reach the catalyst bed 65, it must travel vertically upwardly to the lower surface of the trap section 68. This is a relatively high height and this provides good assurance that water cannot impinge upon the catalyst bed 65. Furthermore, this construction precludes the likelihood that water will be able to enter the engine through the exhaust port 56. It should be remembered that, the lower trap surface is above the lower most exhaust port and, thus, this insurance is provided.

It should be readily apparent that, when the watercraft 20 having the transom 22 is traveling through the body of water in which it is operating at a low speed or when idling therein, the through the hub propeller discharge opening 42 will be quite deeply submerged. At this same time, the exhaust pressure generated in the exhaust system of the engine 23 will be relatively low. Therefore, the back pressure will be such that the exhaust gases cannot be freely discharged through the path described.

To permit good engine performance under these conditions, there is provided an above the water exhaust gas discharge through which the exhaust gases may pass. As will become apparent, however, this discharge is disposed so that it is taken at a point downstream of the catalyst bed 65 so as to ensure that the exhaust gases will be treated by the catalyst bed 65 even when discharged through this outlet.

To this end, the exhaust discharge pipe 75 may be formed with a restricted idle exhaust passage (not shown) which opens into a small expansion chamber, and thereon to further expansion chambers as necessary, and ultimately a restricted above the water exhaust gas discharge opening formed in the rear of the spacer plate 31. As should be readily apparent, the opening is above the water under all running conditions and, in fact, is at a height slightly higher than that of the transom 22. Hence, the exhaust gases under idle can be discharged through this opening. As noted, however, these exhaust gases will have been treated by passing through the catalyst bed 65. They will also have been silenced by the expansion in at least one expansion chamber.

It should be readily apparent that the positioning of the trap device 68 in the power head and, specifically within the protective cowling 25, gives rise to an area of high heat within this protective cowling. This heat is in juxtaposition to the cowling member 27 which, as has been noted, is formed from a nonmetallic material. Hence, it is desirable to ensure that heat is dissipated from this area. A system for cooling the trap device 68 and also the exhaust guide 31 is provided and this includes part of the normal cooling system for the engine 23. In this regard, the engine 23 is water cooled. It is provided with suitable cooling jackets and any type of known internal circulatory system.

As is typical of outboard motor practice, a water pump is preferably driven by the drive shaft 32. The capacity of the water pump 85 is greater than that required for merely engine cooling. This is because some of the cooling water is bled off for cooling portions of the exhaust system, as will become apparent.

The water pump draws water from the body of water in which the watercraft 20 is operating through an underwater inlet 86 that is formed in the lower unit 35 at a point which will be below the water under all normal running conditions. This water is then discharged through a vertically upwardly extending charge conduit 87 toward the exhaust guide plate 31. The upper end of the conduit 87 discharges into a passageway formed in the lower end of the exhaust guide 31. This passageway is intersected by a cross-passage which delivers water to the cooling jacket of the engine 23 in a known manner. However, a large portion of the water pumped by the water pump is delivered to an exhaust guide cooling jacket 91 through a supply port. The exhaust guide cooling jacket 91 encircles not only the exhaust passages 58 to which the exhaust pipes 59 are affixed, but also the passages 64 that supply the exhaust gases to the trap section 68 downstream and around the catalyst bed 65. In addition the water jacket 91 extends around the passage 74 of the guide plate that receive the exhaust gases from the trap section 73 and deliver them to the exhaust outlet pipe 75. Hence, there will be substantial cooling water to cool the exhaust guide plate 31 and none of this water will have been previously passed through the cooling jacket of the engine 23.

The trap device 68 is also cooled and to this end it is provided with a double wall construction so as to define a cooling jacket 93 around the bulk the trap section. This cooling jacket 93 is provided with coolant from the exhaust guide cooling jacket 91 through a plurality of passages formed in the exhaust guide 31 and matching passages formed in the underside of a flange of the trap section 68.

After the coolant has circulated through the cooling jacket 91 of the exhaust guide 31 and the jacket 95 of the trap section 68, it is delivered by a line 98 to the cooling jacket of the engine on either the up or downstream sides of this cooling jacket for mixing with the remaining cooling water in the engine before return to the body of water in which the watercraft is operating through a drain line 99 (FIG. 1) that has a discharge 100 in the lower unit 35 at or below the water level.

It should further be noted that the exhaust guide has a further cooling jacket 101 that extends beneath the upper resilient support members 45.

Means may be provided, including a valve positioned along the conduit 87 or at a similar location for controlling the flow of cooling water from the pump to the engine 23 and exhaust system.

As should be apparent from the foregoing description, the construction of the outboard motor exhaust system and, particularly, the positioning of the catalyst 65 ensures that the catalyst will not be impacted by water that may enter the exhaust system through the underwater exhaust gas discharge 42. In spite of this and particularly if operating in marine environments, there may nevertheless become some salt water vapor that will contact the catalyst 65. This material will accumulate primarily on the lower surface of the catalyst bearing in mind that the flow is upwardly through the catalyst 65 to the trap section 68. In addition, any solid particles that may be discharged from the exhaust system and enter the expansion chamber 61 through the exhaust pipes 59 may also collect on the catalyst 65 and adversely affect its performance.

Figure 5:
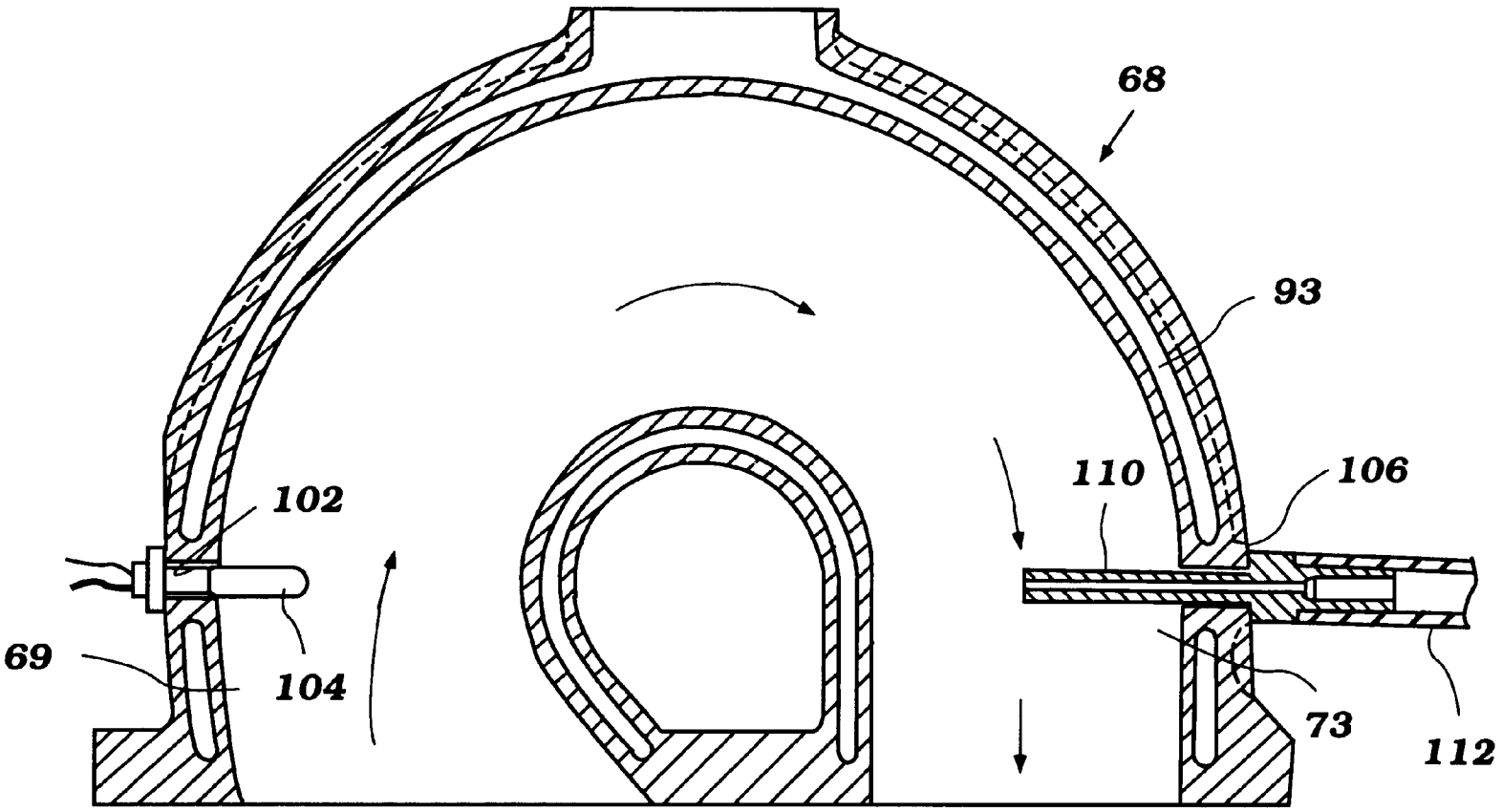
FIG. 5 is an enlarged cross-sectional view of a trap portion of the exhaust components illustrated in FIG. 4, with an exhaust gas probe connected thereto.

Accordingly, in accordance with the present invention, an exhaust gas sampling port 106 is preferably provided in the vertically extending outlet section 73 of the trap 68. Preferably, the passage defining the port 106 is internally threaded. As illustrated in FIG. 4, the port 106 is normally closed with a plug 108 having threads thereon engaging the threads of the port. As illustrated in FIG. 5, however, the plug 108 may be removed and the tip of an exhaust gas probe 110 inserted therethrough. Preferably, the exhaust probe 110 is of the type which has a body which is externally threaded for engagement with the threads of the port 106, and having a passage therethrough leading to a hose 112.

An opposite end of the hose 112 may be conveniently connected to an exhaust gas analyzer 114 for determining the exhaust gas content. The hose 112 is preferably extended through a passage 116 in the cowling 25 of the motor. Exhaust gas passes through the body of the probe 110 and into the hose 112 and thereon to the analyzer 114.

This particular arrangement is advantageous since the exhaust probe 110 may be conveniently attached to the exhaust system and then be completely removed (including the hose 112) when testing is completed. As arranged, the testing permits determination of whether the exhaust gases are being properly catalyzed, and thus whether the catalyst bed 65 is functioning properly or has been contaminated or the like.

One advantage to this arrangement is that the cost of manufacture of the engine 23 is reduced, since no dedicated exhaust gas probe or analyzer need be provided for the engine. In addition, the position of the port 106 in the portion of the exhaust system above the guide 31 permits easy access to the exhaust system and the port for installing the probe 110.

In accordance with the present invention, and as best illustrated in FIG. 5, means are provided for determining the temperature of the exhaust gas which has passed through the catalyst bed 65. This means preferably comprises a sensor 104 extending through a port 102.

The port 102 is preferably provided through the vertically (upwardly) extending inlet section 69 of the trap 68 just downstream from the catalyst bed 65. The exhaust gas temperature probe 104 preferably extends through this port 102, and sends temperature signals to an ECU or other location.

The temperature information from the exhaust gas temperature sensor 104 may be used to control a number of engine operating functions as is well known in the art. In addition, the temperature data may be used to ensure during exhaust gas sampling with the exhaust gas sampling probe 104 that the catalyst 65 has reached operating temperature and erroneous results are not obtained.

Of course, the foregoing description is that of preferred embodiments of the invention, and various changes and modifications may be made without departing from the spirit and scope of the invention, as defined by the appended claims.

What is claimed is:

1. An outboard motor having a water propulsion unit powered by an internal combustion engine, the engine positioned within a cowling of the motor, said engine having at least one exhaust port for discharging combustion products therefrom, an exhaust system for discharging exhaust gases from said exhaust port to a point external to the motor, said exhaust system having a first section in which a catalyst is positioned, a trap section downstream of said first portion, and a discharge, and further including an exhaust gas sampling port for sampling exhaust gasses positioned in said trap section of said exhaust system.

2. The outboard motor in accordance with claim 1, wherein said trap section has a first generally vertically extending section extending from said first section, a generally horizontal portion and then a generally vertically downwardly extending section leading to said discharge.

3. The outboard motor in accordance with claim 2, wherein said exhaust gas sampling port is provided in said downwardly extending section of said trap section of said exhaust system.

4. The outboard motor in accordance with claim 1, further including an exhaust gas temperature sensor extending into said exhaust system between said catalyst and said exhaust gas sampling port.

5. The outboard motor in accordance with claim 1, wherein said engine is positioned above an exhaust guide of said motor and said trap section is positioned above said exhaust guide.

6. The outboard motor in accordance with claim 5, wherein said catalyst is positioned below said exhaust guide.

7. The outboard motor in accordance with claim 1 wherein the internal combustion engine and cowling comprise a power head and a drive shaft housing and lower unit depend from said power head and contains the water propulsion device for an associated water craft, transmission means for driving said water propulsion device from said engine.

8. The outboard motor in accordance with claim 7, wherein said trap section is generally "U"-shaped, having a first upwardly extending portion, a second curved portion and a third downwardly extending portion leading to said discharge.

9. The outboard motor in accordance with claim 8, wherein said exhaust gas sampling port is positioned in said downwardly extending portion.

10. The outboard motor in accordance with claim 7, further including an exhaust gas probe having its tip extending through said exhaust gas sampling port into said exhaust system.

11. The outboard motor in accordance with claim 7, further including a second port in said exhaust system positioned between said catalyst and said exhaust gas sampling port.

12. The outboard motor in accordance with claim 11, wherein an exhaust gas temperature sensor is positioned in said second port.

13. The outboard motor in accordance with claim 9, wherein a second port is positioned in said first upwardly extending portion and an exhaust gas temperature probe is mounted in said exhaust gas sampling port.

14. The outboard motor in accordance with claim 7, wherein said first part of said exhaust system extends to a bottom side of an exhaust guide positioned below said engine, and an exhaust pipe is removably connected to a top side of said exhaust guide.

* * * * *